US006263845B1

(12) United States Patent
Lancefield et al.

(10) Patent No.: US 6,263,845 B1
(45) Date of Patent: Jul. 24, 2001

(54) PHASE CHANGE MECHANISM

(75) Inventors: Timothy Mark Lancefield, Bicester; Ian Methley, Long Hanborough, both of (GB)

(73) Assignee: Mechadyne PLC, Oxon (GB)

( * ) Notice: Subject to any disclaimer, the term of this patent is extended or adjusted under 35 U.S.C. 154(b) by 0 days.

(21) Appl. No.: 09/530,682

(22) PCT Filed: Oct. 26, 1998

(86) PCT No.: PCT/GB98/03190

§ 371 Date: May 3, 2000

§ 102(e) Date: May 3, 2000

(87) PCT Pub. No.: WO99/23362

PCT Pub. Date: May 14, 1999

(30) Foreign Application Priority Data

Nov. 3, 1997 (GB) ..... 9723118

(51) Int. Cl.[7] ..... F01L 1/344

(52) U.S. Cl. ..... 123/90.17; 123/90.15; 74/568 R; 464/2; 464/160

(58) Field of Search ..... 123/90.15, 90.16, 123/90.17, 90.18, 90.31; 74/568 R; 464/1, 2, 160, 161

(56) References Cited

U.S. PATENT DOCUMENTS

| | | | | |
|---|---|---|---|---|
| 5,167,206 | * | 12/1992 | Suga | 123/90.17 |
| 5,263,442 | | 11/1993 | Hara | 123/90.17 |
| 5,447,126 | * | 9/1995 | Kondoh et al. | 123/90.17 |
| 5,592,857 | * | 1/1997 | Hara | 74/568 R |

FOREIGN PATENT DOCUMENTS

| | | |
|---|---|---|
| 0 594 104 | 4/1994 | (EP) . |
| 0 704 605 | 4/1996 | (EP) . |

OTHER PUBLICATIONS

"Mechadyne Unveils Latest Cam Phaser Range," Automotive Engineer, vol. 23, No. 1, Jan. 1998, p. 10.

* cited by examiner

*Primary Examiner*—Weilun Lo
(74) *Attorney, Agent, or Firm*—Smith-Hill and Bedell

(57) ABSTRACT

In a phase change mechanism in which the phase of a driven member (10) relative to a drive member (12) is adjusted by axial displacement of an actuating rod (30) connected to the piston (50) of a hydraulic jack rotatable with the drive and driven members, the cylinder (52) of the hydraulic jack has a double-skinned wall, and the gap (54) between the two skins of the cylinder wall serves as a passage for supplying oil to and from one of the working chambers of the hydraulic jack.

3 Claims, 2 Drawing Sheets

PHASE CHANGE MECHANISM

FIELD OF THE INVENTION

The present invention relates to a phase change mechanism for an engine camshaft to enable the valve timing of the engine to be varied to suit different operating conditions.

BACKGROUND OF THE INVENTION

As Is well known, valve timing has a significant effect on engine performance and the optimum setting varies with engine operating conditions. To optimise performance under different operating conditions, it is necessary to be able to vary the valve timing. Complex systems have been proposed that vary the duration of valve events, this being equivalent to using a cam with a different profile, while other systems only vary the phase of a camshaft acting on one set of valves relative to the engine crankshaft and/or relative to a second camshaft acting on the remaining valves.

Various phase change mechanisms have been proposed in the past but they have suffered from various problems. Some, though feasible, have been costly to implement while other have developed excessive friction or not proved to be reliable. Furthermore, many could not be fitted as a modification to existing engines as they required much of the valve train and cylinder head to be redesigned.

The Applicants' earlier EP-A-0 733 154 discloses a valve operating mechanism comprising a hollow shaft, a sleeve journalled on the hollow shaft and fast in rotation with a cam, a coupling yoke connected by a first pivot pin to the hollow shaft and by a second pivot pin to the sleeve and means for moving the yoke radially to effect a phase change between the hollow shaft and the sleeve. The means for moving the yoke radially comprise an actuating rod slidably received in the hollow shaft, a cam surface on the actuating rod and a plunger passing through a generally radial bore in the hollow sleeve to cause the yoke to move radially in response to axial movement of the actuating rod.

The above valve operating mechanism is only one example in which a phase change is brought about by axial movement of an actuating rod relative to the camshaft. Other phase change mechanisms that use an actuating rod movable axially relative to the camshaft are also known. The present invention is particularly concerned with a hydraulic actuator for displacing the actuating rod of such a phase l5 change mechanism.

It has already been proposed to mount a hydraulic jack on the drive pulley or sprocket of the camshaft and to connect the actuating rod of the piston of the hydraulic jack. The most common prior art proposal for supplying oil to the hydraulic jack employs drillings in the camshaft. In such a case, however, the length of the drillings and the restrictions placed on their diameter, make it difficult to ensure an adequate supply of oil to the hydraulic jack to allow the phase of the camshaft to be adjusted rapidly.

Summary of the invention

With a view to mitigating the foregoing disadvantage, the present invention provides a phase change mechanism in which the phase of a driven member relative to a drive member is adjusted by axial displacement of an actuating rod connected to the piston of a hydraulic jack rotatable with the drive and driven members, wherein the cylinder of the hydraulic jack has a double-skinned wall, and the gap between the two skins of the cylinder wall serves as a passage for supplying oil to and from one of the working chambers of the hydraulic jack.

Preferably, the end of the cylinder remote from the drive and driven members communicates with supply and return passages in a stationary engine cover or spider, one passage lying in line with the axis of rotation of the drive and driven members and communicating directly with a first working chamber of the hydraulic jack and the other passage communicating with the other working chamber of the hydraulic jack by way of the gap between the two skins of the cylinder wall.

The invention allows oil passages of large flow through is cross section to be employed while retaining the benefit of a compact design that allows the phase change mechanism to be retrofitted to existing engines.

BRIEF DESCRIPTION OF THE DRAWINGS

The invention will now be described further, by way of example, with reference to the accompanying drawings, in which.

DETAILED DESCRIPTION OF THE DRAWINGS

Figure 1:
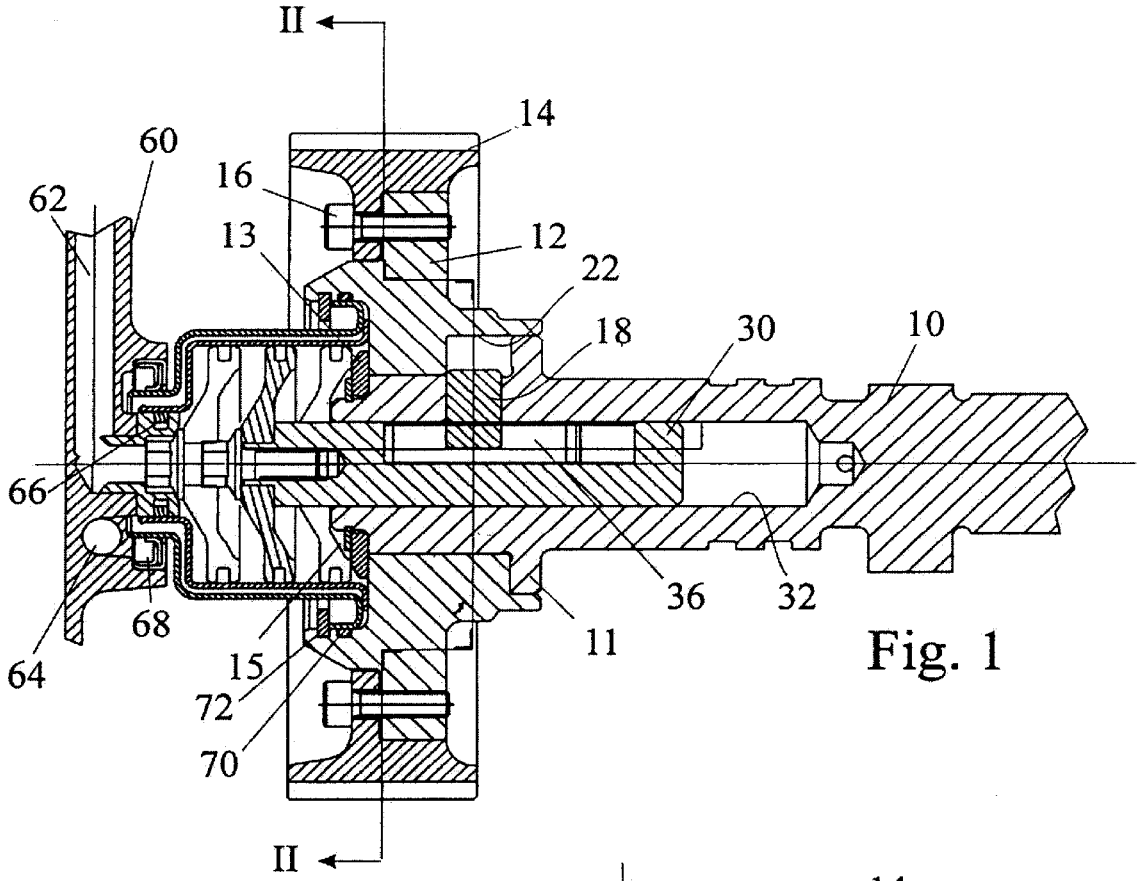
FIG. 1 is a section through a camshaft fitted with a phase change mechanism, taken through a plane passing through the rotational axis.

In FIGS. 1 to 4, a camshaft 10 is driven by a drive pulley 12 to which a toothed ring 14 is attached by means of bolts 16 to allow the camshaft 10 to be driven from the engine crankshaft by means of a toothed belt. The drive pulley 12 is journalled on the camshaft 10 and is retained axially on the camshaft 10 by being captive between a collar 11 projecting from the camshaft 10 and a washer 13 that is held in place on the camshaft 10 by a circlip 15.

Figure 2:
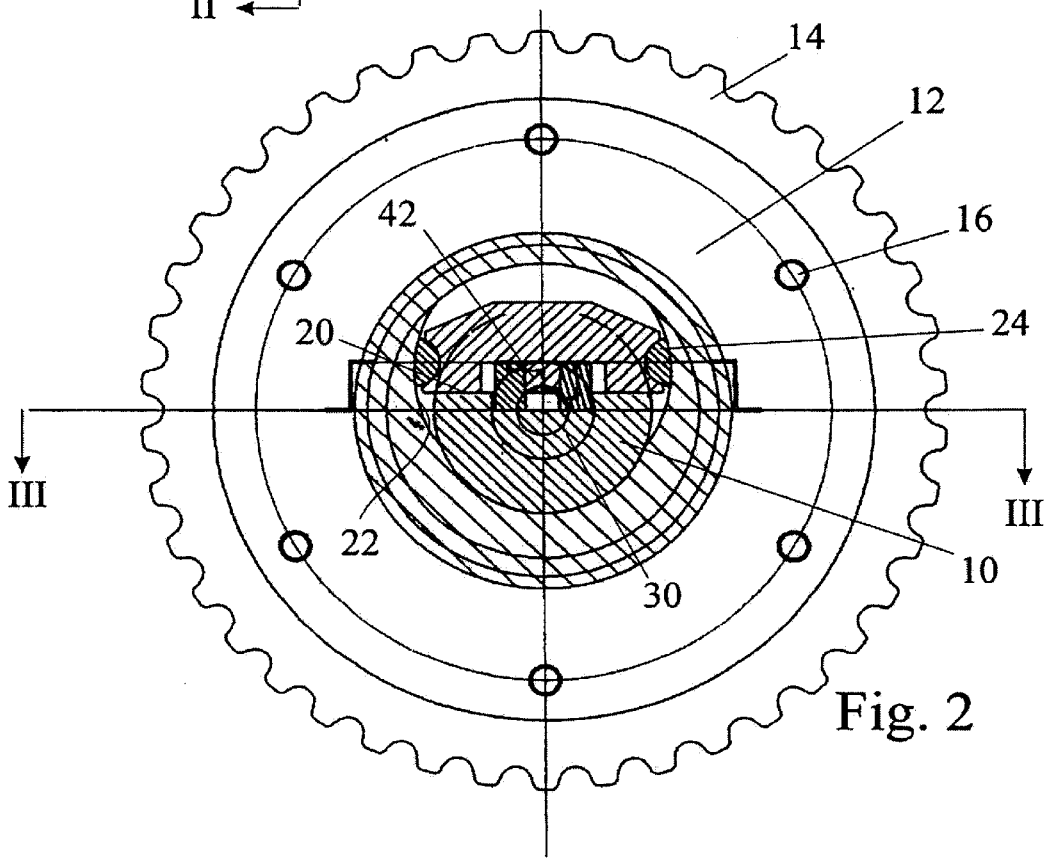
FIG. 2 is section along the line II—II in FIG. 1.
Figure 3:
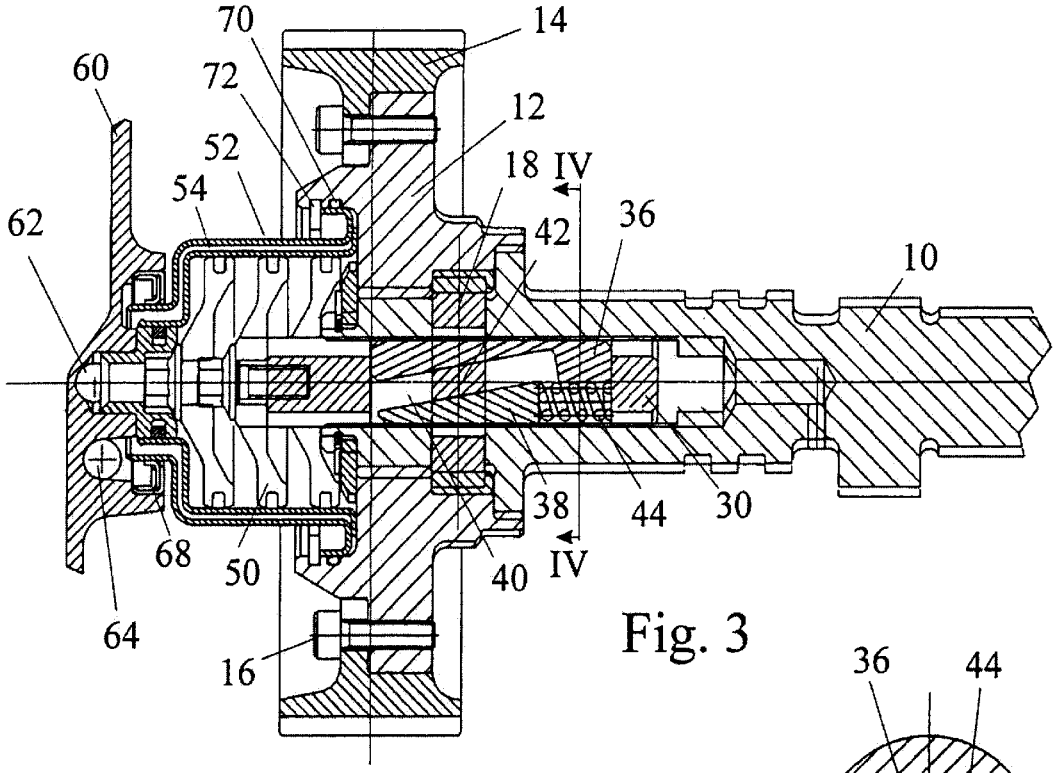
FIG. 3 is section along the line III—III in FIG. 2.
Figure 4:
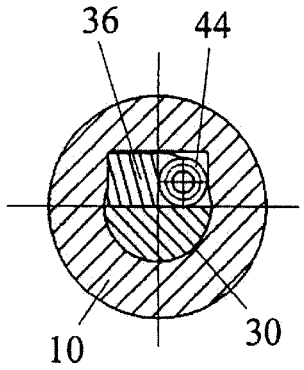
FIG. 4 is a section along the line IV—IV in FIG. 3.

Torque is transmitted from the pulley 12 to the camshaft 10 by means of a phase change mechanism that comprises a transverse pin 18 located in a flat 20 in the camshaft and a yoke 22 fast in rotation with the drive pulley 12. As seen in FIG. 2, the pin 18 has at its opposite ends two shoes 24 that engage a contoured inner surface of the yoke 22. The shoes 24 are spring-biased so that the pin 18 simultaneously contacts the yoke 22 and the shoulder of the Flat 20 of the camshaft 10 to transmit torque from the yoke 22 to the camshaft 10.

It will be clear also from FIG. 2 that the phase of the camshaft 10 relative to the drive pulley 12 depends on the position of the pin 18 and that by moving the pin 18 from side to side in FIG. 2 the phase of the camshaft 10 relative to the drive pulley 12 may be changed.

To vary the phase between the camshaft 10 and the drive pulley 12, an axially displaceable actuating rod 30 is located in a blind bore 32 in the end of the camshaft 10. The actuating rod 30 is formed with a flat on which there are located two wedges 36, 38 that are best shown in the sectional plane of FIG. 3. The wedges 36 and 38 taper in opposite directions and thus define between them a gap 40 that is inclined relative to the rotational axis. A tooth 42 of the transverse pin 18 is located in the gap 40 such that when the actuating rod 30 is moved axially the pin 18 is moved from side to side. In order to avoid backlash a spring 44, also shown in the section of FIG. 4, urges the wedge 38 in an axial direction in a sense to reduce the width of the gap 40 and ensure that the tooth 42 makes surface contact with both wedges 36 and 38 simultaneously.

To bring about axial movement of the actuating rod 30 the end of the latter projecting beyond the front end of the drive pulley 12 is connected to a piston 50 reciprocable within a cylinder 52. The wall of the cylinder 52 is double skinned, there being an annular gap 54 between the inner and outer skins of the cylinder. The double skinned cylinder 52 is formed by inserting one cup of pressed steel into another and a gap 54 remains around the periphery of the inner cup to act as an oil passage, to permit oil to flow to the working chamber lying to the right of the piston 50 as viewed in FIGS. 1 and 3. The cylinder 52 is mounted in a recess in the front of the drive pulley 12 with its outer skin sealed by an O-ring 70 relative to the recess and is retained within the recess by a circlip 72. The inner skin of the cylinder only contacts the recess at a few points about its periphery, leading a gap of large through flow cross section through which oil may flow into the working chamber lying to the right of the piston 50, as viewed.

The engine is fitted with a stationary front cover 60 or a spider having supply and return oil passages 62 and 64 leading to a connection socket that fits over the end of the double skinned cylinder 52. Rotary seals 66 and 68 in the cover 60 seal against the inner and outer surfaces of the cylinder 52. In this way, oil is supplied directly from the oil passage 62 to the working chamber shown to the left of the piston 50, while oil passes from the passage 64 through the gap 54 to the working chamber lying the right of the piston 50 as viewed. This configuration allows oil passage of large through flow cross section to be used thereby enabling rapid adjustment of the axial position of the actuating rod 30 and the application of a sufficient force to overcome any frictional force on the actuating rod.

Figure 5:
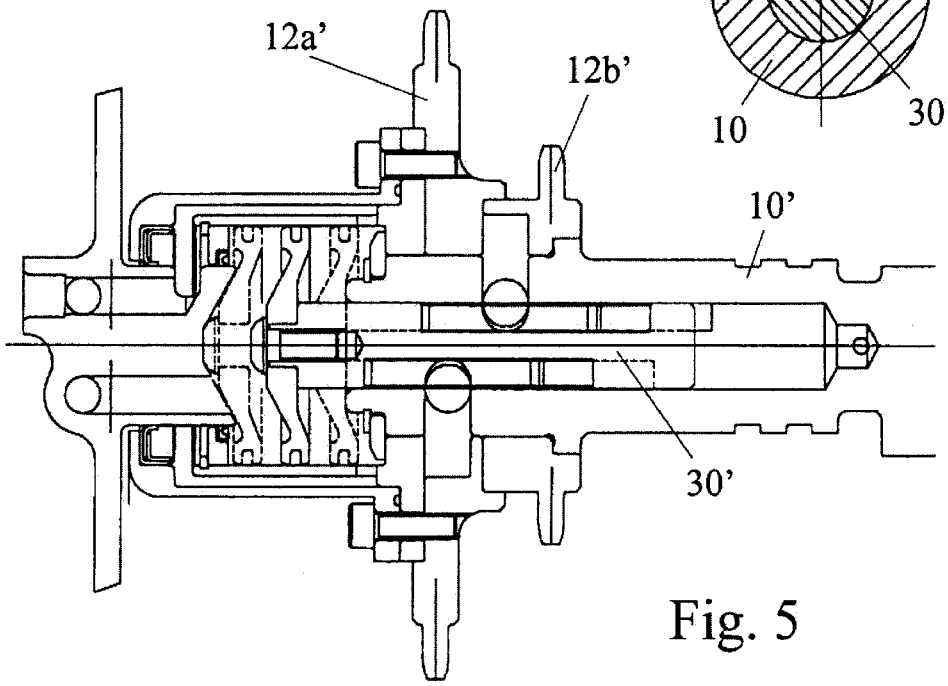
FIG. 5 is schematic less detailed section similar to that of FIG. 1 but showing an alternative embodiment.

The camshaft of FIG. 5 differs from that of FIGS. 1 to 4 in that a single phase change mechanism is used to alter the phase of two different camshafts relative to the engine crankshaft. The essential difference resides in that the camshaft 10' has two sprockets 12*a*' and 12*b*' journalled on it instead of only one. The sprocket 12*a*' is equivalent to the drive pulley 12 in FIGS. 1 to 4 and the transmission of torque from the crankshaft through the sprocket 12*a* to the camshaft 10' is exactly the same as previously described. The second sprocket 12*b*is used to transmit torque from the camshaft 10' to a second camshaft (not shown) by way of a chain or toothed belt. The second sprocket 12*b*' is coupled to the camshaft 10' by means of a second yoke, transverse pin and wedges on the opposite side of the actuating rod 30' that are essentially those previously described. In this manner, when the actuating rod is displaced axially the sprocket 12*a*' is phase shifted in one direction while the sprocket 12*b*' is phase shifted in the opposite direction. This arrangement therefore allows a single hydraulic jack acting on only one actuating rod to bring about a change of phase of one camshaft in one direction relative to the engine crankshaft and a phase change of a second camshaft in the opposite sense.

The two phase changes need not necessarily be equal as the extent of the phase change for a given axial displacement of the actuating rod will depend on the tapering angle of the wedges and it is possible for the two sets of wedges to have different angles of taper.

It will be appreciated that the invention is not restricted to the particular form of phase change mechanism described above but may be applied to any mechanism, for example that in EP-A-0 733 154, that relies on axial displacement of an actuating rod to effect a phase change.

What is claimed is:

1. A phase change mechanism in which the phase of a driven member (12) relative to a drive member (10) is ni adjusted by axial displacement of an actuating rod (30) iconnected to the piston (50) of a hydraulic jack rotatable with the drive and driven members (12, 10), characterised in that the cylinder (52) of the hydraulic jack has a double-skinned wall, and the gap between the two skins of the 10 cylinder wall serves as a passage for supplying oil to and from one of the working chambers of the hydraulic jack.

2. A phase change mechanism as claimed in clarify 1, wherein the end of the cylinder (52) remote from the drive and driven members (12, 10) communicates with supply and return passages (62, 64) in a stationary engine cover (60) or spider, one passage (62) lying in line with the axis of rotation of the drive and driven members (12, 10) and communicating directly with a first working chamber to the hydraulic jack and the other passage (64) communicating with the other working chamber of the hydraulic jack by way of the gap between the two skins of the cylinder wall.

3. A phase change mechanism as claimed in claim 2, wherein the end of the cylinder (52) is received in a socket in the engine cover (60) or spider that comprises rotary seals (66, 68) for sealing against the cylinder.

* * * * *